US005727902A

United States Patent [19]

Brown

[11] Patent Number: 5,727,902

[45] Date of Patent: Mar. 17, 1998

[54] METHOD AND APPARATUS FOR MAINTAINING THE POSITION OF A CONTAINMENT BOOM IN A FAST FLOWING WATERWAY

[75] Inventor: Leonard G. Brown, Millet, Canada

[73] Assignee: Envirotech Nisku Inc., Nisku, Canada

[21] Appl. No.: 723,563

[22] Filed: Sep. 30, 1996

[51] Int. Cl.[6] ..... E02B 15/04

[52] U.S. Cl. ..... 405/63; 405/60; 405/66; 405/72

[58] Field of Search ..... 405/63–72, 60, 405/62, 73, 26, 21, 15, 74, 52; 210/242.3, 923; 114/242, 254

[56] References Cited

U.S. PATENT DOCUMENTS

| | | | |
|---|---|---|---|
| 1,397,891 | 11/1921 | Jones | 405/72 X |
| 3,651,647 | 3/1972 | Flaviani | 405/71 |
| 3,665,713 | 5/1972 | Rath | 405/62 |
| 3,973,406 | 8/1976 | Casey | 405/66 |
| 4,303,351 | 12/1981 | Milgram | 405/66 |
| 4,511,285 | 4/1985 | Eriksson | 405/66 |
| 4,661,013 | 4/1987 | Jenkins | 405/15 X |
| 4,789,269 | 12/1988 | Ayers et al. | 405/158 |
| 4,798,156 | 1/1989 | Langeland et al. | 405/166 X |

FOREIGN PATENT DOCUMENTS

| | | | |
|---|---|---|---|
| 1528855 | 5/1968 | France | 405/63 |
| 2490260 | 3/1982 | France | 405/63 |
| 2001543 | 2/1979 | United Kingdom | 405/63 |

*Primary Examiner*—Dennis L. Taylor
*Attorney, Agent, or Firm*—Anthony R. Lambert

[57] ABSTRACT

A method for maintaining the position of a containment boom in a fast flowing waterway. Firstly, providing an elongate containment boom having a first side, a second side, a first end, a second end and a longitudinal axis. The containment boom consists of a plurality of smaller substantially coaxial boom sections. Secondly, providing a plurality of floats having floating deflector appendages. Thirdly, placing the plurality of floats at spaced intervals along the containment boom between the boom sections, with the floating deflector appendage of each float oriented on the first side of the containment boom extending outwardly at an angle in relation to the longitudinal axis and pointing generally toward the second end. Fourthly, positioning the containment boom in a fast flowing waterway with the second end anchored adjacent the shore and releasing the first end of the containment boom into the fast flowing waterway such that fast flowing water passing along the second side of the containment boom causes the first end of the containment boom to swing into the fast moving waterway until fast flowing water passing along the first side of the containment boom from the first end to the second end exerts an equalizing force upon the floating appendages to maintain the containment boom in a static equilibrium within the fast flowing waterway.

4 Claims, 4 Drawing Sheets

METHOD AND APPARATUS FOR MAINTAINING THE POSITION OF A CONTAINMENT BOOM IN A FAST FLOWING WATERWAY

FIELD OF THE INVENTION

The present invention relates to a method and apparatus for maintaining the position of a containment boom in a fast flowing waterway and, in particular, a containment boom used to contain an oil spill on a river.

BACKGROUND OF THE INVENTION

When an oil spill occurs on the river, a containment boom is positioned down stream of the oil spill. The containment boom is used to channel the oil spill into calmer water adjacent the shore where measures can be taken to remove the oil from the water to minimize environmental damage.

In order to maintain the desired positioning of the containment boom, a plurality of lines are run from the containment boom and secured along the shore. This method of securing the containment boom has a number of inherent disadvantages. The securing of all the lines is a time consuming and labour intensive process. This is a serious drawback, as time is of the essence when attempting to contain an oil spill. As the containment boom strains against the lines, the lines tend to slap against the surface of the water. This emulsifies the oil and makes it more difficult to separate the oil from the water. Logs, ice or other objects floating downstream, tend to strike and pull out the shore lines resulting in boom failure.

SUMMARY OF THE INVENTION

What is required is an alternative method and apparatus for maintaining the position of a containment boom in a fast flowing waterway.

According to one aspect of the present invention there is provided a method for maintaining the position of a containment boom in a fast flowing waterway. Firstly, providing an elongate containment boom having a first side, a second side, a first end, a second end and a longitudinal axis. The containment boom consists of a plurality of smaller substantially coaxial boom sections. Secondly, providing a plurality of floats having floating deflector appendages. Thirdly, placing the plurality of floats at spaced intervals along the containment boom between the boom sections, with the floating deflector appendage of each float oriented on the first side of the containment boom extending outwardly at an angle in relation to the longitudinal axis and pointing generally toward the second end. Fourthly, positioning the containment boom in a fast flowing waterway with the second end anchored adjacent the shore and releasing the first end of the containment boom into the fast flowing waterway such that fast flowing water passing along the second side of the containment boom causes the first end of the containment boom to swing into the fast moving waterway until fast flowing water passing along the first side of the containment boom from the first end to the second end exerts an equalizing force upon the floating appendages to maintain the containment boom in a static equilibrium within the fast flowing waterway.

With the above described method, a containment boom can be deployed in a fraction of the time without fear of subsequent failure.

According to another aspect of the present invention there is provided a combination that includes an elongate containment boom and a plurality of floats having floating deflector appendages. The elongate containment boom has a first side, a second side, a first end, a second end and a longitudinal axis. The containment boom consists of a plurality of smaller substantially coaxial boom sections. The plurality of floats are positioned at spaced intervals along the containment boom between the boom sections, with the floating deflector appendage of each float oriented on the first side of the containment boom extending outwardly at an angle in relation to the longitudinal axis and pointing generally toward the second end.

Although beneficial results may be obtained through the use of the combination, as described above, the deflecting force needed to maintain the containment boom in a desired orientation within a waterway varies. Even more beneficial results may, therefore, be obtained when the floating deflector appendage on the float is angularly adjustable. This enables the deflecting force to be decreased or increased as required.

Although beneficial results may be obtained through the use of the combination, as described above, sometimes it is desirable to contain the oil spill along one shore and at other times it is preferable to contain the oil spill along the opposite shore. Even more beneficial results may, therefore be obtained when the floating deflector appendage is detachably mounted to the float and the float has two mounting positions. Which of the two mounting positions is selected will depend upon the shore toward which the oil is to be directed.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
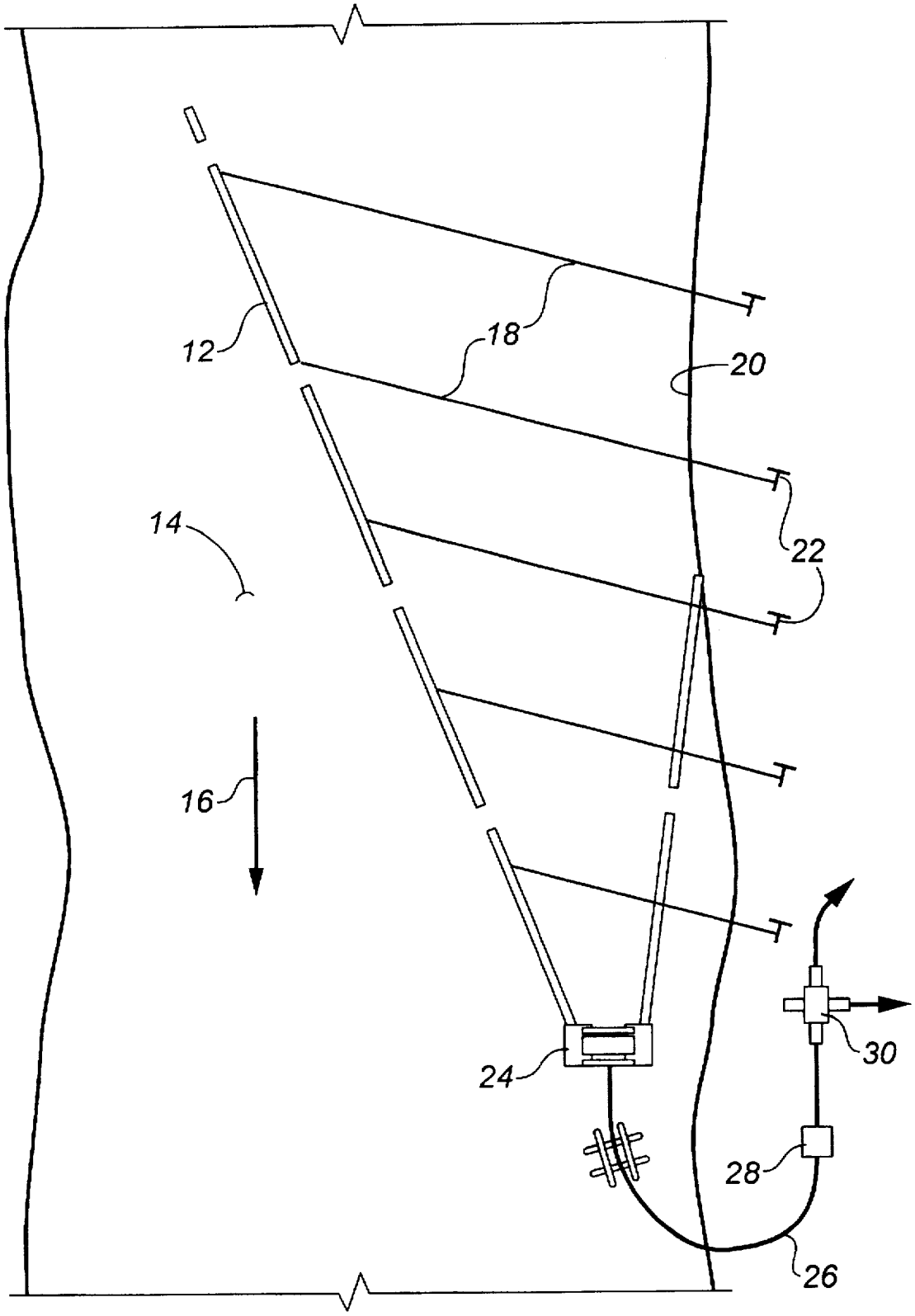
FIG. 1. (Prior Art)
FIG. 1 is a top plan view labelled as PRIOR ART of a containment boom deployed in a fast flowing waterway.

The preferred embodiment, an apparatus for maintaining the position of a containment boom in a fast flowing waterway generally identified by reference numeral 10, will now be described with reference to FIGS. 1 through 5.

Referring to FIG. 1, there is illustrated a Prior Art containment boom 12, positioned in a fast flowing waterway 14 with the direction of the current indicated by arrow 16. Containment boom 12 is secured in position by means of rope lines 18 that are anchored to shore 20 by means of ground anchors 22. Containment boom 12 converges to a skimmer 24. Fluid skimmer by skimmer 24 is drawn through a suction hose 26 by pump 28 and then to a separation manifold 30.

Figure 2:
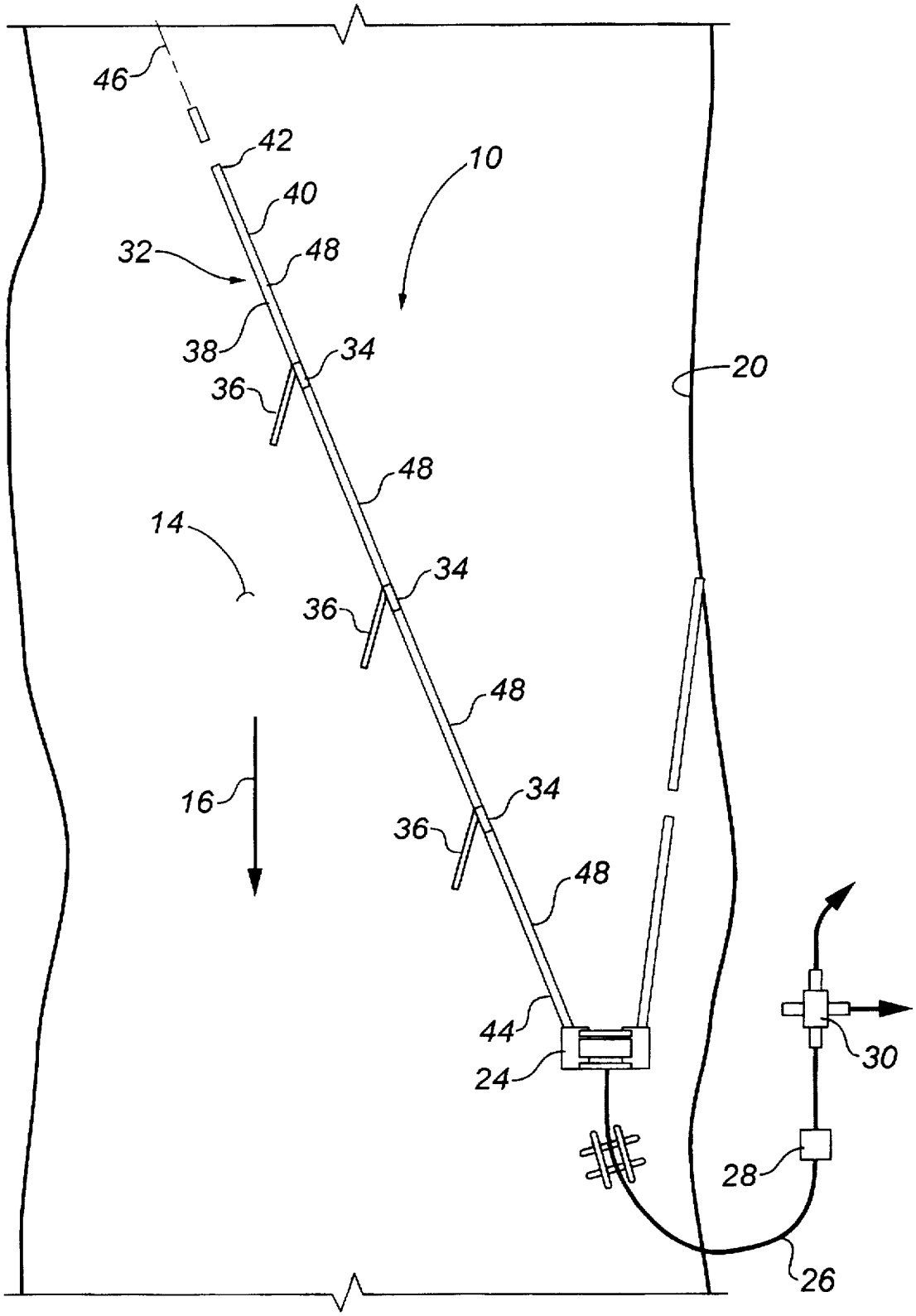
FIG. 2 is a top plan view of a containment boom constructed in accordance with the teachings of the present invention deployed in a fast flowing waterway.

Referring to FIG. 2, apparatus 10 is a combination that includes an elongate containment boom 32 and a plurality of floats 34 having floating deflector appendages 36. Elongate containment boom 32 has a first side 38, a second side 40, a first end 42, a second end 44 and a longitudinal axis 46. Containment boom 32 consists of a plurality of smaller substantially coaxial boom sections 48. Floats 34 are positioned at spaced intervals along containment boom 32 between boom sections 48. Floating deflector appendage 36 of each float 34 is oriented on the same side (in the illustration toward first side 38) of containment boom 32 extending outwardly at an angle in relation to longitudinal axis 46. Floating deflector appendages 36 all point in the same direction (in the illustration toward second end 44).

Figure 3:
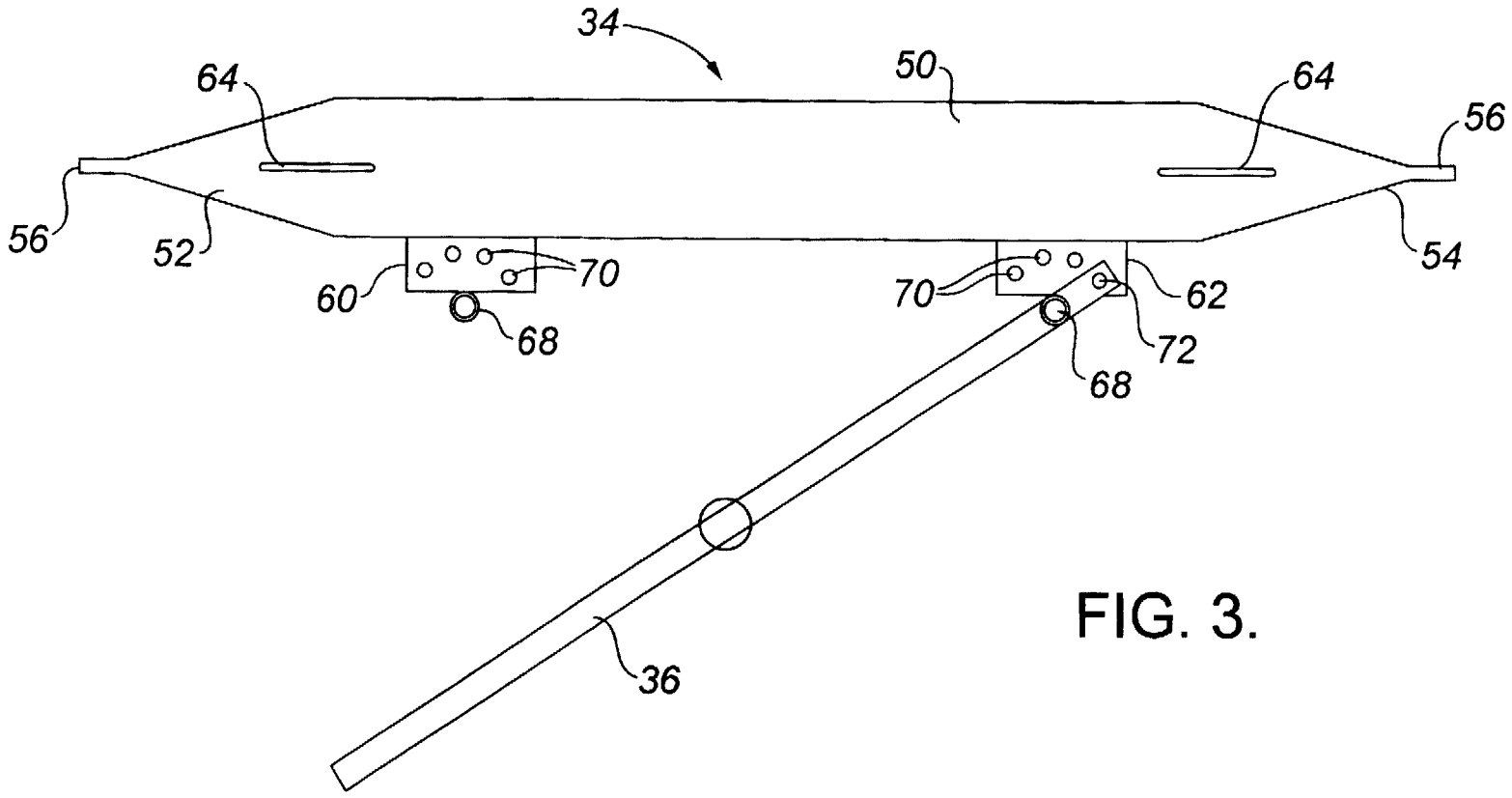
FIG. 3 is a top plan view of a float constructed in accordance with the teachings of the present invention.
Figure 4:
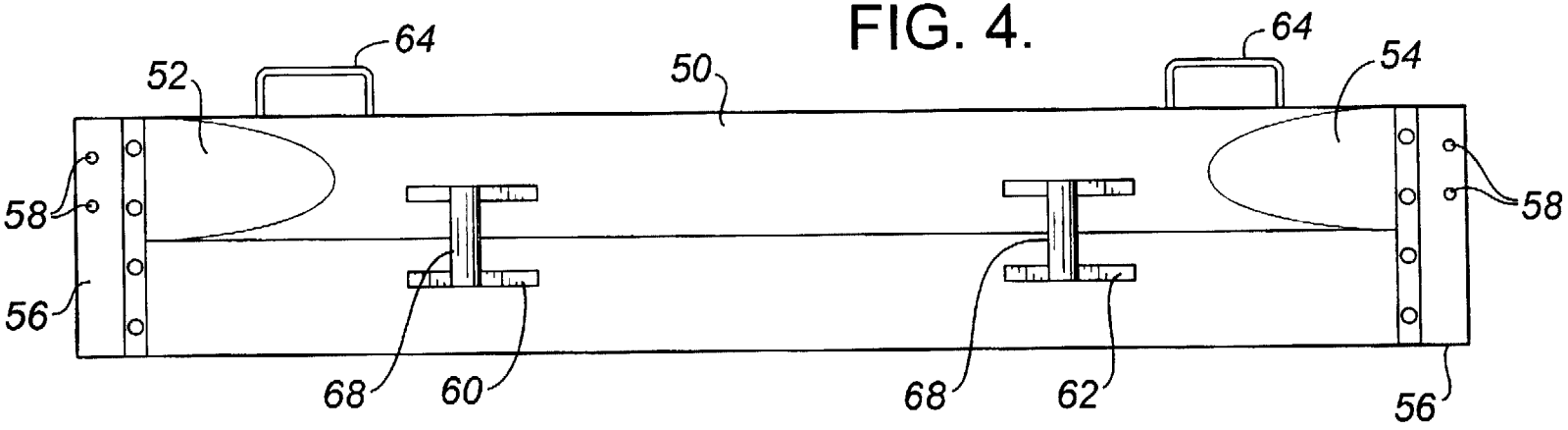
FIG. 4 is a side elevation view of a body of the float illustrated in FIG. 3.
Figure 5:
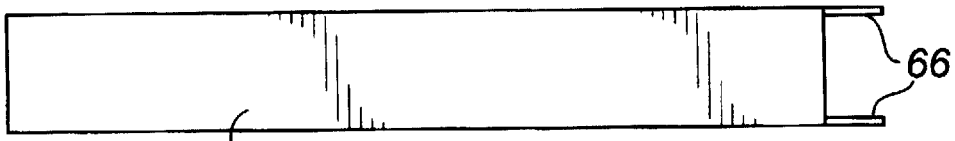
FIG. 5 is a side elevation view of a floating deflector appendage of the float illustrated in FIG. 3.

Referring to FIGS. 3 through B, float 34 is shown in greater detail. Float 34 includes a main body portion 50 from which floating deflector appendage 36 extends. Referring to FIGS. 3 and 4, main body 50 has a tapered first end 52 and a tapered second end 54, both of which terminate in a connector plate 56 having attachment apertures 58. Two mounting brackets 60 and 62 are provided, adjacent first end 52 and second end 54, respectively. Main body has handles 64, for ease of handling. Referring to FIG. 5, deflector appendage 36 has two parallel projecting tabs 66. Referring to FIG. 3, deflector appendage 36 is pivotally secured to one of mounting brackets 60 or 62 by means of pivot pin 68. Each of mounting brackets 60 and 62 have a plurality of angle adjustment apertures 70. The pivotal position of deflector appendage 36 is fixed by inserting a locking pin 72, through the uppermost one of tabs 66 and into one angle adjustment apertures 70.

The use and operation of apparatus 10 will now be described, with reference to FIGS. 3 through 5, in accordance with the preferred method for maintaining the position of a containment boom in a fast flowing waterway. Firstly, provide elongate containment boom 32, as described above. Secondly, provide a plurality of floats 34, as described above. Thirdly, place the plurality of floats 34 at spaced intervals along containment boom 32 between boom sections 48. The orientation of floating deflector appendage 36 will depend upon the conditions encountered. Floating deflector appendage 36 will be secured to either mounting bracket 60 or mounting bracket 62, depending upon which shore the oil is being directed to. The angular positioning of floating deflector appendage 36 will depend upon the strength of the current, which dictates the amount of deflecting force required. Angular adjustments are made, as required, by pulling locking pin 72 out so that deflecting appendage 36 is free to pivot about pivot pin 68. Once the desired angular position is selected, locking pin 72 is inserted through the uppermost one of tabs 66 and into one angle adjustment apertures 70 to lock deflecting appendage 36 is the desired position. Referring to FIG. 2, each deflecting appendage 36 is oriented on first side 38 of containment boom 32 extending outwardly at an angle in relation to longitudinal axis 46 and pointing generally toward second end 44. Fourthly, positioning containment boom 32 in fast flowing waterway 14 with second end 44 anchored adjacent shore 20. The direction of the current is indicated by arrow 16 with the fast flowing water passing from first end 42 toward second end 44. First end 42 of containment boom 32 is then released into fast flowing waterway 14. Fast flowing water passing along second side 40 of containment boom 32 will initially cause first end 42 of containment boom 32 to swing into fast flowing waterway 14, until fast flowing water passing along first side 38 of containment boom 32 exerts an equalizing force upon floating deflector appendages 36 to maintain containment boom 32 in a static equilibrium within fast flowing waterway 14.

In initial experiments, the Applicant attempted to secured floating deflector appendages 36 directly to boom sections 48. These experiments proved to be failures. When defector appendages 36 were attached directly to boom sections 48, they pushed boom sections 48 down allowing oil to escape containment. The use of floats 34 positioned between boom sections 48 solved this problem by holding up boom sections 48 so they floated higher in the water and by absorbing the force of the current engaging deflector appendages 36.

Floats 34 can be made out of a variety of materials. Beneficial results have been obtained through the use of a foam filled aluminum shell.

It will be apparent to one skilled in the art that modifications may be made to the illustrated embodiment without departing from the spirit and scope of the invention as hereinafter defined in the claims.

The Embodiments of the invention in which an exclusive property or privilege is claimed are defined as follows:

1. A method for maintaining the position of a containment boom in a fast flowing waterway, comprising the steps of:

firstly, providing an elongate containment boom having a first side, a second side, a first end, a second end and a longitudinal axis, the containment boom consisting of a plurality of smaller substantially coaxial boom sections;

secondly, providing a plurality of floats having floating deflector appendages;

thirdly, placing the plurality of floats at spaced intervals along the containment boom between the boom sections, with the floating deflector appendage of each float oriented on the first side of the containment boom extending outwardly at an angle in relation to the longitudinal axis and pointing generally toward the second end; and fourthly, positioning the containment boom in a fast flowing waterway with the second end anchored adjacent the shore and releasing the first end of the containment boom into the fast flowing waterway such that fast flowing water passing along the second side of the containment boom causes the first end of the containment boom to swing into the fast moving waterway until fast flowing water passing along the first side of the containment boom from the first end to the second end exerts an equalizing force upon the floating appendages to maintain the containment boom in a static equilibrium within the fast flowing waterway.

2. In combination:

an elongate containment boom having a first side, a second side, a first end, a second end and a longitudinal axis, the containment boom consisting of a plurality of smaller substantially coaxial boom sections; and a plurality of floats having floating deflector appendages, positioned at spaced intervals along the containment boom between the boom sections, with the floating deflector appendage of each float oriented on the first side of the containment boom extending outwardly at an angle in relation to the longitudinal axis and pointing generally toward the second end said deflectors acting to hold the boom sections up so they float higher in the water.

3. The combination as defined in claim 2, wherein the floating deflector appendage on the float is angularly adjustable.

4. The combination as defined in claim 2, wherein the floating deflector appendage is detachably mounted to the float and the float has two mounting positions.

* * * * *